United States Patent [19]

Kazle

[11] Patent Number: 4,908,917

[45] Date of Patent: Mar. 20, 1990

[54] SLIDE AND LATCH MECHANISM

[75] Inventor: John V. Kazle, Oakdale, Minn.

[73] Assignee: Minnesota Mining and Manufacturing Company, St. Paul, Minn.

[21] Appl. No.: 345,941

[22] Filed: May 1, 1989

[51] Int. Cl.[4] ..... A44B 17/00

[52] U.S. Cl. ..... 24/615; 24/616

[58] Field of Search ..... 24/615, 616, 618, 573

[56] References Cited

U.S. PATENT DOCUMENTS

| | | | |
|---|---|---|---|
| 1,737,246 | 11/1929 | Jones | 24/616 |
| 3,308,517 | 3/1967 | Geldwerth | 24/616 |
| 3,844,000 | 10/1974 | Hedu | 24/615 |
| 4,369,553 | 1/1983 | Yuda | 24/618 |
| 4,532,682 | 8/1985 | Murao | 24/616 |

*Primary Examiner*—Victor N. Sakran

*Attorney, Agent, or Firm*—Donald M. Sell; Walter N. Kirn; William B. Barte

[57] ABSTRACT

A slide and latch bracket for releasably securing an article to a mounting surface. The bracket comprises first and second members, each being adapted to be secured to either the article or mounting surface. The first member is shaped to provide a substantially flat, U-shaped channel having side walls for slideably receiving the second member. The second member also has a flat base, side rails adapted to be received along the side walls of the first member, and a releasable latch for bearing against a mating portion of the first member for locking the members together.

3 Claims, 1 Drawing Sheet

SLIDE AND LATCH MECHANISM

FIELD OF THE INVENTION

This invention generally relates to two-part mechanisms and brackets, each part of which is adapted to be secured to either an article or a supporting surface, and which are releasably joined together to releasably secure articles to the respective mounting surface.

BACKGROUND OF THE INVENTION

Numerous devices have previously been known for releasably locking articles together. Typical of such devices are window and door latches in which an arm is provided with a lip or hook which in turn is adapted to engage and lock with a surface of a corresponding member.

It is also known to provide assemblies for enabling members to be inserted into and slid relative to each other. Drawer glides of various configurations are thus known in which respective members are provided to further control the relative positions. Such glides are also known, as in file drawers and the like, to include latches to lock the drawers in place.

In the field of portable equipment intended to be carried by personnel in a manner facilitating ready access to the equipment, it is also known to provide a variety of mounting brackets, holsters and the like. Such brackets and holsters are typically attached to service belts, and are designed to directly receive a specifically shaped article. In some cases, such brackets, holsters, etc. may also include snaps or other means for locking the equipment in place. It is not known to provide an inexpensive two-piece molded assembly, one of the pieces being adapted to be permanently attached to the equipment and the other to a support surface and to include means allowing the equipment to be securely fastened to the support surface such that it can be used and not because uncoupled by an operator's movements during normal use.

SUMMARY OF THE INVENTION

Unlike prior art devices, the present invention is directed to a universably adaptable slide and latch mechanism which can be used to removably attach an article of virtually any shape to a mounting surface, so that the article may be securely locked in place to withstand accidental dislodgment during an operator's normal movements, and will still allow the equipment to be normally operated while so locked in place.

The slide and latch bracket of the present invention thus comprises first and second members, one of which is adapted to be secured to either an article or a mounting surface, while the other member is adapted to be secured to the other of the article or mounting surface. The first member has a substantially flat base, and side walls extending parallel to each other at opposite sides of the base, the ends of the member being open so as to form a generally U-shaped, open ended channel. Each of the side walls further include a plurality of projections extending inward from the top of the walls and substantially parallel with the base, and the base includes an inner surface with at least one recess therein having a tapered wall extending toward and adjacent to one open end.

The second member is adapted to be secured to the other of the article or mounting surface. It also has a substantially flat base, and has rails on opposite sides adapted to be received at either of the open ends of the base of the first member, between the inner surface and projections, and to be slid therealong to become supported therebetween. This member further comprises a flange at one end for bearing against the base at one of the open ends thereof when the second member is fully inserted into the first member, and has a releasable latch at the opposite end for bearing against the base of the first member at the opposite end thereof when the second member is fully inserted, to lock the second member within the first member until said latch is released. The tapered wall of the recess on the inner surface of the first member is adapted to facilitate easy entry of said second member into said first member.

DETAILED DESCRIPTION

The bracket of the present invention is particularly adapted for use in mounting articles to supporting surfaces in a manner in which they may be used while so mounted. For example, personnel working in fast food restaurants and the like may frequently utilize a headset and transceiver by which orders may be communicated to the kitchen. In such an instance, the transceiver is desirably mounted to a belt in a fashion enabling the transceiver to be operated while so mounted, and which still allows the transceiver to be removed from the belt and another substituted in its stead, etc. Other environments in which the bracket may be desirably used include belt mounted tools and other portable implements, and articles such as electronic tape decks, fire extinguishers, etc., which are desirably removably mounted on a support surface.

Figure 1:
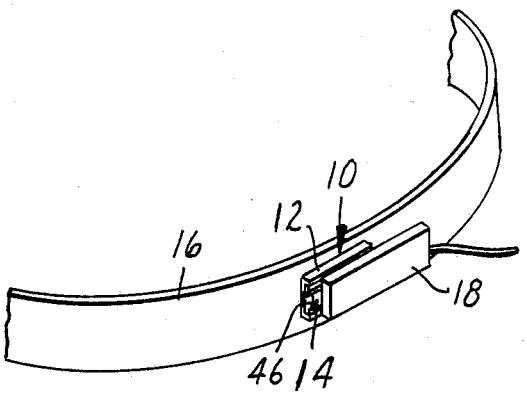
FIG. 1 is a perspective view showing a typical manner in which the slide and latch bracket of the present invention may be used to secure an article to a supporting surface.

Thus, as shown in FIG. 1, the bracket 10, may be formed of two parts 12 and 14, and a first part 12 attached, such as by rivets or the like, to a supporting surface such as a belt 16 to be worn by appropriate personnel. The second part, 14 is shown attached to an article, such as a transceiver 18 in a manner allowing it to be operated while so mounted, while yet allowing it to be removed, etc.

Figure 2:
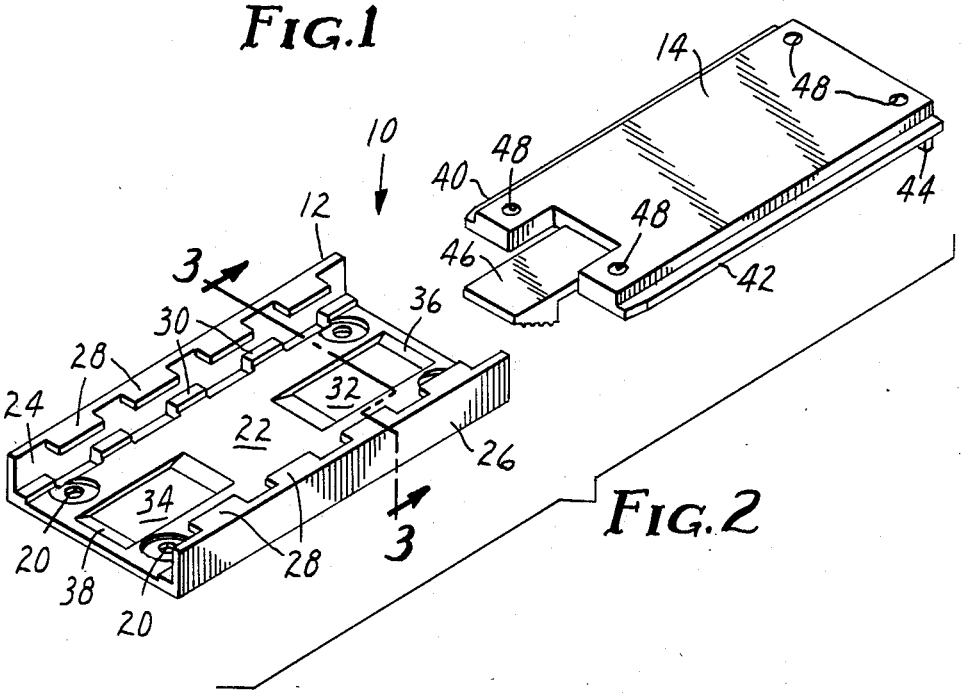
FIG. 2 is a perspective view of the two halves of a preferred embodiment of the bracket of the present invention.

Details of the preferred embodiment of the present invention are set forth in FIG. 2. In that Figure it may be seen that the bracket comprises a first member 12 which is adapted to receive a second member 14 each of the members are in turn adapted to be attached either to an article or a supporting surface at which the article is to be mounted. Accordingly, the first member 12 is adapted with a plurality of holes 20 through which rivets or other attachment members may be placed in order to mount the first member 12 onto a supporting surface. As shown in FIG. 1, such a surface may preferably be the belt to be worn by an operator of the article to be attached to the second member 14. As may there been seen, the member 12 is constructed to provide a basically U-shaped channel or trough into which the member 14 may be slid and ultimately latched in place. The member 12 thus includes a base portion 22 and parallel side walls 24 and 26, thus leaving both the opposite ends and the top open so as to allow the member 14 to be inserted from either of the open ends. Each of the walls 24 and 26 is further provided with a series of projections 28 along the upper edge of the respective walls and a plurality of elevated portions 30 at the base of each of the walls thereby forming a channel between the projections and elevated portions 28 and 30 along which the outer extremity of the second member 14 may be slid when the two members are to be mounted together. The interior surface of the base 22 is further provided with recessed portions 32 and 34, each of which have an inclined wall 36 and 38 closest to the respective open end thereby facilitating entry of a latching portion of the second member 14 to be described in more detail hereinafter.

The second member 14 is as noted above designed to be inserted into and latched with the first member. The second member 14 thus has a substantially flat construction, being particularly characterized by rails 40 and 42 along each side of the member, which rails are adapted to be received into the channels formed between the projections and raised portions 28 and 30 respectively on each side wall of the first member 12. Upon entry of a second member 14 into the first member 12, a rear flange 44 prevents the second member from being inserted beyond a desired location, while a frontward protruding latch portion 46 at that location snaps over the outer edge of the opposite open end of the first member 12 so as to prevent withdrawal of the second member unless the latch is lifted clear of the base of the first member. As may be seen in FIG. 2, the latch 46 in a preferred embodiment is simply a molded semi-flexible finger which protrudes beyond the leading edge of the second member 14 and has a sharply angled projection extending below so as to engage the edge of the base of the first member 12. Likewise the downward portion with the lower surface of the projecting portion is serrated to provide ready tactile contact with the latch. The second member 14 similarly has a plurality of holes 48 to facilitate riveting or other attachment means for attaching the member to an appropriate article.

Figure 3:
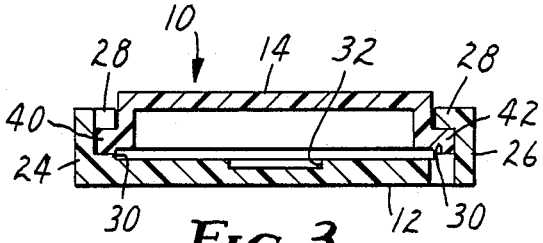
FIG. 3 is a cross-section nominally taken along the lines 3—3 of FIG. 2, but in a manner in which the two parts shown separately in FIG. 2 are shown assembled.

The manner in which the respective members 12 and 14 meet together is further shown in the cross-sectional view in FIG. 3 taken along the lines 3—3 of FIG. 2, wherein all of the respective components are similarly identified.

In a preferred embodiment, each of the respective members 12 and 14 is made via injection molding of a dimensionally stable plastic such as lexan, polycarbonate, or the like. In such an embodiment, certain design parameters are particularly important. For example, the two members must be designed to facilitate ready assembly and separation so as to allow the article to which the second member is attached to be readily removed from the supporting surface. Likewise, when such an article is attached to the supporting surface, it must not become uncoupled by movement of an operator and yet allow normal use of the article while so positioned. Furthermore, as, in a preferred embodiment, the article to be attached to the second member may well be a transceiver adapted to be utilized in fast food restaurants and the like, it is desirable that the supporting surface such as a belt to be worn by an operator be repeatedly laundered to ensure both cleanliness and a pleasing appearance. Thus it is essential that the first member which is secured to the belt or like supporting surface and the means for attaching that portion to the supporting surface stand up to washing such as would occur in an automatic washing machine.

Accordingly it will be recognized that as the two members are to be inserted, the projecting portion of the latch will be first received into one of the two tapered edges 36 or 38 of the respective recesses 32 or 34, depending upon into which of the open ends of the first member the leading or latch portion of the second member is being inserted. Likewise, to facilitate entry, the leading edge of the respective rails 40 and 42 may be desirably inwardly tapered so as to provide additional relief between the edges of the rail and respective channels formed along each of the side walls 24 and 26.

While the slide and latch bracket of the present invention has been shown with respect to a preferred embodiment set forth in FIGS. 1–3, other embodiments of similar constructions are of course within the scope of the present invention. Thus for example, the latch means 46 may be replaced by a number of other known variants, depending upon the ease with which the members are desirably unlatched for subsequent removal. Likewise, the channels into which the side rails of the second member are to be inserted may be altered to provide varying amounts of clearance and freedom of movement, many such variants being dictated by desirable practices well known in the injection molding art.

I claim:

1. A slide and latch bracket for releasably securing an article to a mounting surface comprising (a) a first member adapted to be secured to either said article or said mounting surface and having a substantially flat base and side walls extending parallel to each other at opposite sides of the base, the ends of the member being open so as to form a generally a U-shaped, open ended channel, each of said side walls further comprising a plurality of projections extending inward from the top of the walls and substantially parallel with said base, and said base having an inner surface with at least one recess therein having a tapered wall extending toward and adjacent to a said open end, and (b) a second member adapted to be secured to the other of said article or mounting surface, and having a substantially flat base with rails on opposite sides adapted to be received at either of said open ends of the base between said inner surface and said projections and to be slid therealong to become supported therebetween, having a flange at one end for bearing against the base at one of said open ends thereof when the second member is fully inserted into the first member, and having a releasable latch at the opposite end for bearing against the base at the opposite end when the second member is fully inserted to lock the second member within the first member until said latch is released, said tapered wall of said recess being adapted to facilitate easy entry of said second member into said first member.

2. A mechanism according to claim 1, wherein the inner surface of said first member further comprises a plurality of spaced apart surfaces adjacent each of said parallel walls and elevated from the remainder of said inner surface of the base for further facilitating movement of the rails of said second member along the first member.

3. A mechanism according to claim 1, wherein said releasable latch further comprises a compliant projecting arm extending parallel to said rails and having a lip adapted to snap over said base to thereby lock the second member in place and adapted to be bent away from the base member to allow withdrawal of the second member.

* * * * *